US006227120B1

(12) United States Patent
Fritz

(10) Patent No.: US 6,227,120 B1
(45) Date of Patent: May 8, 2001

(54) SIMULATED DRAGSTER RIDE

(75) Inventor: Edward Bray Fritz, Valencia, CA (US)

(73) Assignee: Disney Enterprises, Inc., DE (US)

( * ) Notice: Subject to any disclaimer, the term of this patent is extended or adjusted under 35 U.S.C. 154(b) by 0 days.

(21) Appl. No.: 09/275,207

(22) Filed: Mar. 24, 1999

(51) Int. Cl.[7] ..... A63G 21/00
(52) U.S. Cl. ..... 104/60; 105/82; 105/209
(58) Field of Search ..... 104/53, 60; 105/75, 105/82, 194, 209

(56) References Cited

U.S. PATENT DOCUMENTS

| | | | | |
|---|---|---|---|---|
| 3,840,241 | | 10/1974 | Hock . | |
| 4,540,188 | | 9/1985 | Mcloche et al. . | |
| 4,682,547 | | 7/1987 | Schwarzkopf . | |
| 4,877,223 | | 10/1989 | Hackett . | |
| 4,991,514 | | 2/1991 | Powell et al. . | |
| 5,048,867 | | 9/1991 | Gradert . | |
| 5,109,939 | * | 5/1992 | Conaway et al. | 180/89.15 |
| 5,361,705 | | 11/1994 | Powell . | |
| 5,522,321 | | 6/1996 | Mosley et al. . | |
| 5,551,347 | * | 9/1996 | Gutknecht | 104/53 |
| 5,595,121 | | 1/1997 | Elliott et al. . | |

* cited by examiner

*Primary Examiner*—S. Joseph Morano
*Assistant Examiner*—Andrew Wright
(74) *Attorney, Agent, or Firm*—Medlen & Carroll, LLP

(57) ABSTRACT

An amusement ride vehicle capable of generating a natural "wheelie" motion with minimal acceleration is provided. Air springs are used to balance the vehicle about a predetermined center of gravity after passenger loading. The amount of balancing required is minimized by using a link, such as a pivoting control arm, to connect the front wheels of the vehicle to the front end of the chassis, thus enabling the chassis to be automatically balanced independent of the weight of the front wheels, without the need for computer control. Upon acceleration of as little as 0.5 Gs in a forward direction, the front end of the chassis rises smoothly and naturally into a upward arc while the front wheels remain engaged with the trackway. The amount of upward movement is limited by the length of the control arms, and can be further limited using stops, such as jounce and rebound bumpers. Passengers are loaded into the vehicle, and then the front end of the vehicle is levelled to compensate for the added weight of the passengers, for example by filling air springs mounted between the chassis and the front wheels. When the vehicle is levelled, the vehicle is accelerated to cause the front end of the chassis to rise up, "popping a wheelie." As the ride decelerates, the front end drops down to a design height. Since vehicle acceleration causes the wheelie, it is by definition a natural force. This natural wheelie motion transmits the correct feel to the passengers.

22 Claims, 7 Drawing Sheets

SIMULATED DRAGSTER RIDE

FIELD OF THE INVENTION

The present invention relates generally to the field of amusement rides. More particularly, the present invention relates to dragster-type amusement rides.

BACKGROUND OF THE INVENTION

The sport of dragster racing typically involves two vehicles racing against each other on two straight, parallel racing tracks. At one end of the track is a designated starting line and at the opposite end of the track is a designated finish line. A winning vehicle is one that reaches the finish line within the shortest time period. The race commences with the vehicles accelerating from a stationary start. During the sudden acceleration of the vehicles from the starting line, the front ends of the dragsters often raise from the ground. The action which results when the front end lifts during acceleration is commonly referred to as a "wheelie". The rapid acceleration combined with a wheelie makes dragster racing a thrilling experience. Unfortunately, a dragster is an inherently dangerous vehicle during a "wheelie" because the entire front end is lifted off the roadway, making the vehicle unstable, very difficult to control, and a hazard to its occupants and any bystanders.

In a continuing quest to provide thrilling and unique experiences, others have created amusement rides which attempt to simulate the sensation of being in a drag race while eliminating the danger inherent in operating a dragster. None of these rides have been successful in generating an authentic feeling "wheelie."

For example, U.S. Pat. No. 5,522,321, issued to MOSLEY et al. discloses a dragster ride featuring bungee cord acceleration and deceleration structures.

U.S. Pat. No. 4,991,514, issued to POWELL et al. discloses a ride simulating a drag race in which each vehicle is accelerated by a linear induction motor.

U.S. Pat. No. 5,361,705 to POWELL discloses an electrically powered drag racing ride, including a special effects generator for generating sound, hydraulic shaking, and smoke at appropriate times.

Although each of these patents attempts to simulate the thrill of a real dragster race, none of them discloses a means by which to incorporate the "wheelie" motion into the ride. U.S. Pat. No. 3,840,241 to HOCK discloses a sled for sliding on low friction surfaces, such as snow or ice, provides a mechanism for manually raising the front frame of the sled off the ground, generating a sensation similar to that experienced with a "wheelie". However, this sensation is created by the rider pushing against a control bar, and is thus expected, and not as thrilling as a wheelie which is automatically generated by acceleration.

Accordingly, the need exists for a dragster-type amusement ride which permits the front end of the vehicle to rise up automatically to generate a wheelie when a predetermined acceleration occurs, without the accompanying hazards of a dragster vehicle.

SUMMARY OF THE INVENTION

The present invention is a dragster-type amusement ride that simulates a wheelie automatically during acceleration. An objective of the present invention is to achieve this result at a much lower acceleration than would normally be possible with conventional vehicles. Further objectives of the present invention include creating a vehicle that can provide the same "wheelie" effect independent of the passenger loading conditions.

In one embodiment, the present invention provides an amusement ride vehicle for riding along a trackway. The vehicle includes a chassis with a front end and a rear end, a passenger compartment mounted on the chassis for seating at least one passenger, a guidance means for engaging the trackway and for guiding the vehicle along the trackway, a means for accelerating the vehicle in a forward direction along said trackway; and, a means for automatically levelling the chassis (i.e., balancing the chassis about a predetermined center of gravity located at or near the rear end of the chassis) after passengers have been seated in the passenger compartment, so that a natural feeling "wheelie" will be automatically induced when the vehicle is accelerated in a forward direction above some minimal value, such as at least about 0.5 Gs.

In another, more preferred, embodiment the present invention provides an amusement ride simulating a dragster race, including a trackway having a guide rail defining a ride path, and a vehicle for traveling on the trackway, the vehicle including a chassis having a front end and a rear end, a passenger compartment mounted on the chassis for seating at least one passenger, a guide rail engagement means mounted to the vehicle for engaging the guide rail, two drive wheels mounted to a drive axle for rotation, the first drive wheel located at a right rear end of the chassis and the second drive wheel mounted for rotation at a left rear end of the chassis, the drive wheels for propelling the vehicle along the trackway, a motor means mounted to the chassis for rotating the drive wheels about an axis, an automaticlevelling mechanism mounted between the guide rail engagement means and the chassis for raising the front end of the chassis to balance the chassis about a center of gravity located at or near the drive axle to compensate for passenger loading conditions so that wheelies can be generated independent of passenger loading, and without affecting the engagement between the guide rail and the guide rail engagement means. A means for limiting the upward movement of the front end of the chassis during a "wheelie" is also most preferably provided for safety reasons. When the vehicle is accelerated on the trackway to a predetermined level, the front end of the chassis rises up automatically in a natural arc about the axis of the rear wheels until it reaches an uppermost limit. The front end of the chassis will remain at this uppermost limit for so long as the vehicle continues to accelerate above the predetermined minimum value. When the vehicle decelerates below this value, the front end of the chassis will automatically return to its starting position.

These and other objects of the invention will become apparent from the Detailed Description of the Invention, taken in conjunction with the accompanying drawings, which illustrate, by way of example, the principles of the invention.

DETAILED DESCRIPTION OF THE PREFERRED EMBODIMENT

The present invention simulates the "wheelie" motion experienced by a dragster driver during rapid acceleration, without the danger inherent in operating a dragster.

The Trackway

Figure 1:
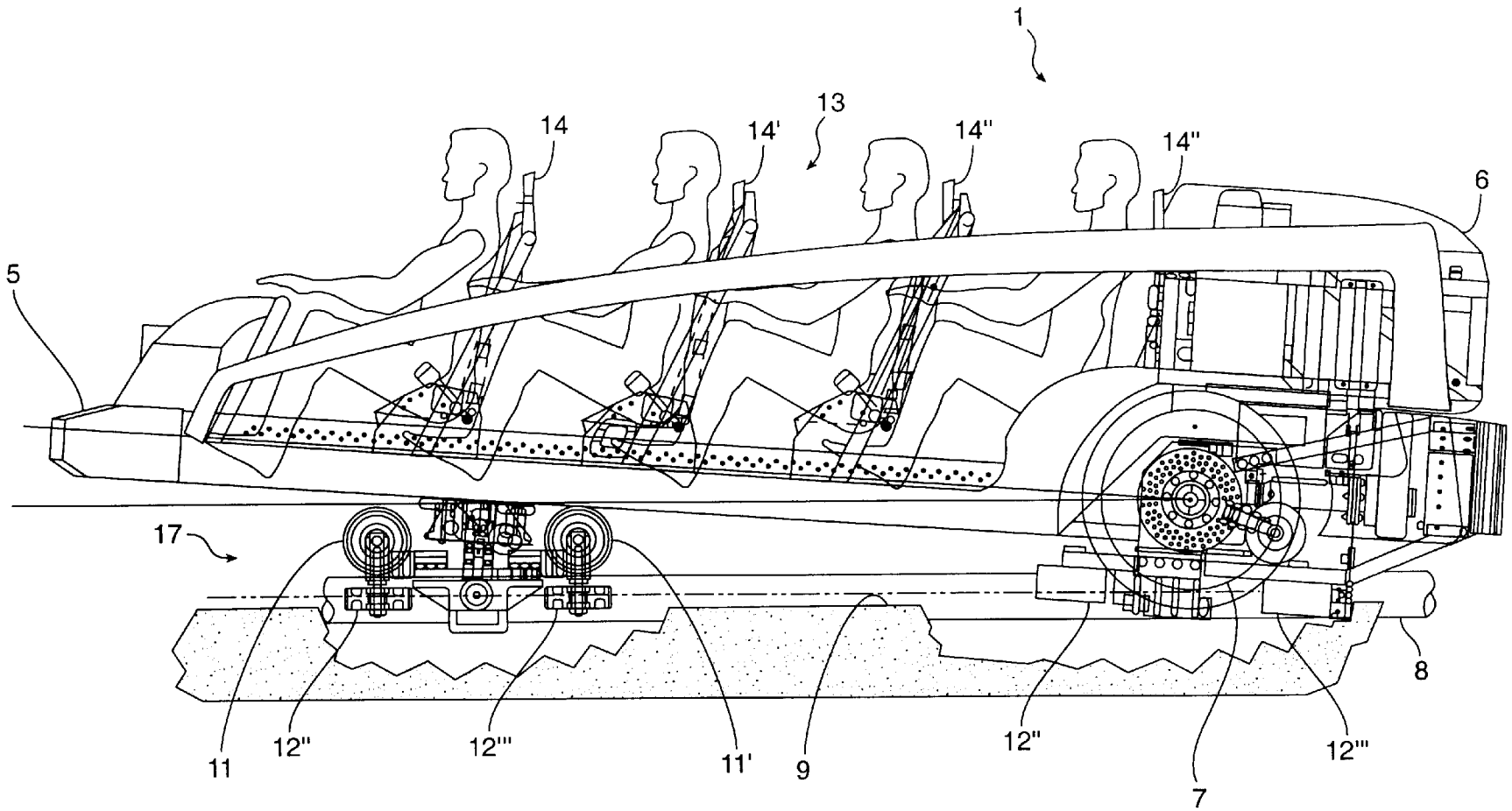
FIG. 1 is a partially sectioned, side view of a vehicle and track of the present invention.
Figure 2:
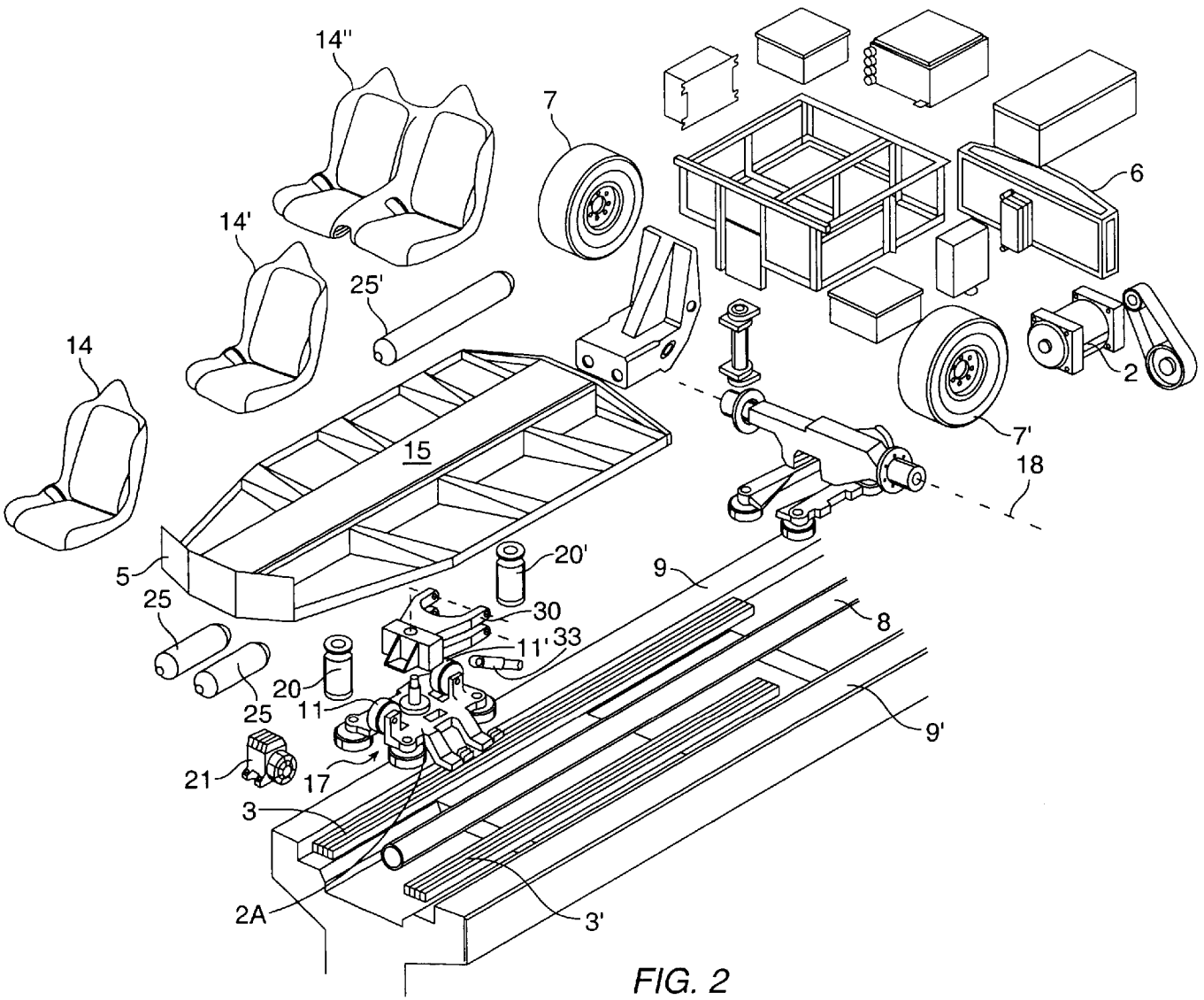
FIG. 2 is an exploded, perspective view of a preferred vehicle and track of the present invention.
Figure 3:
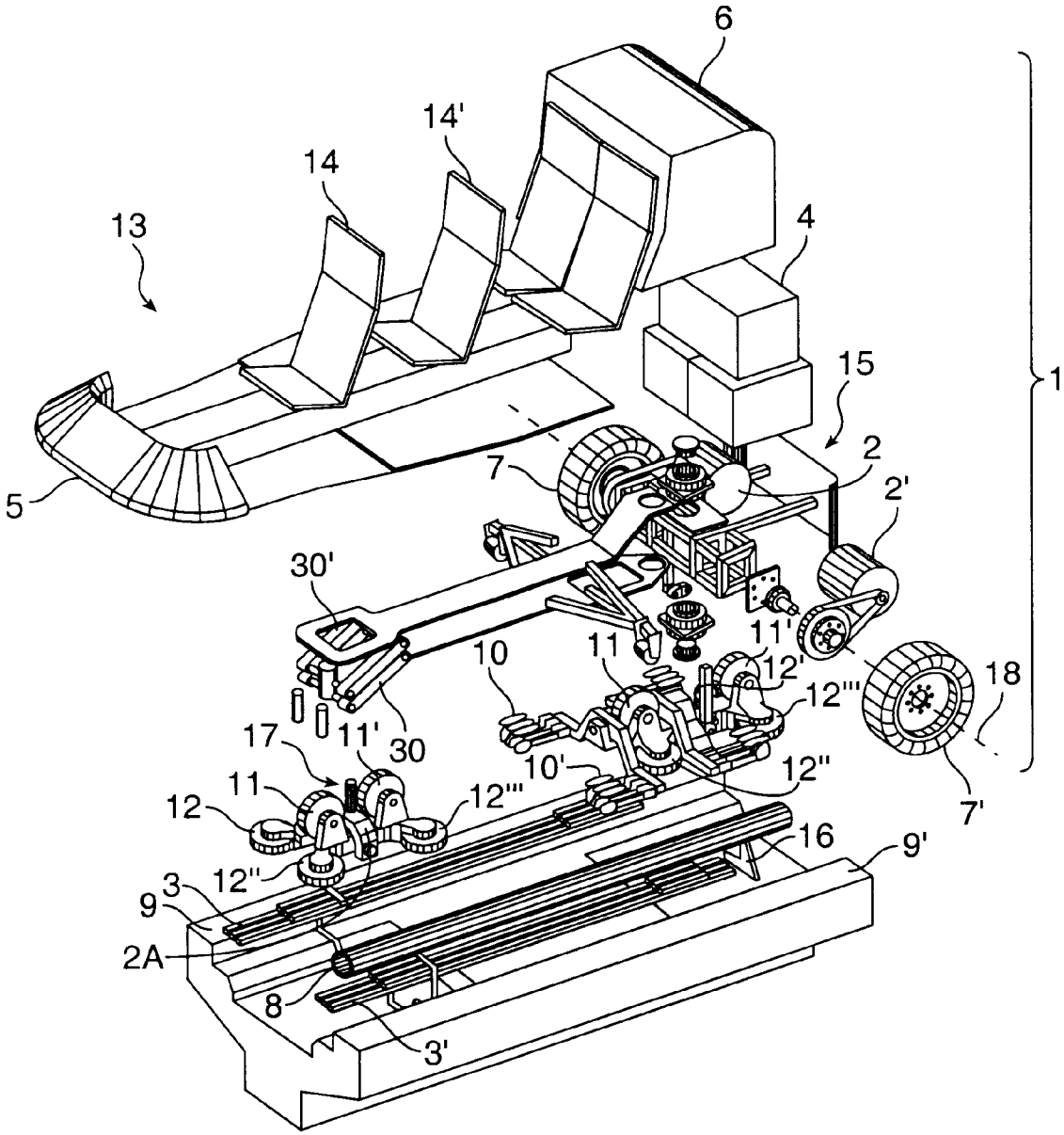
FIG. 3 is an exploded, perspective view of an alternative vehicle and track of present invention.
Figure 4:
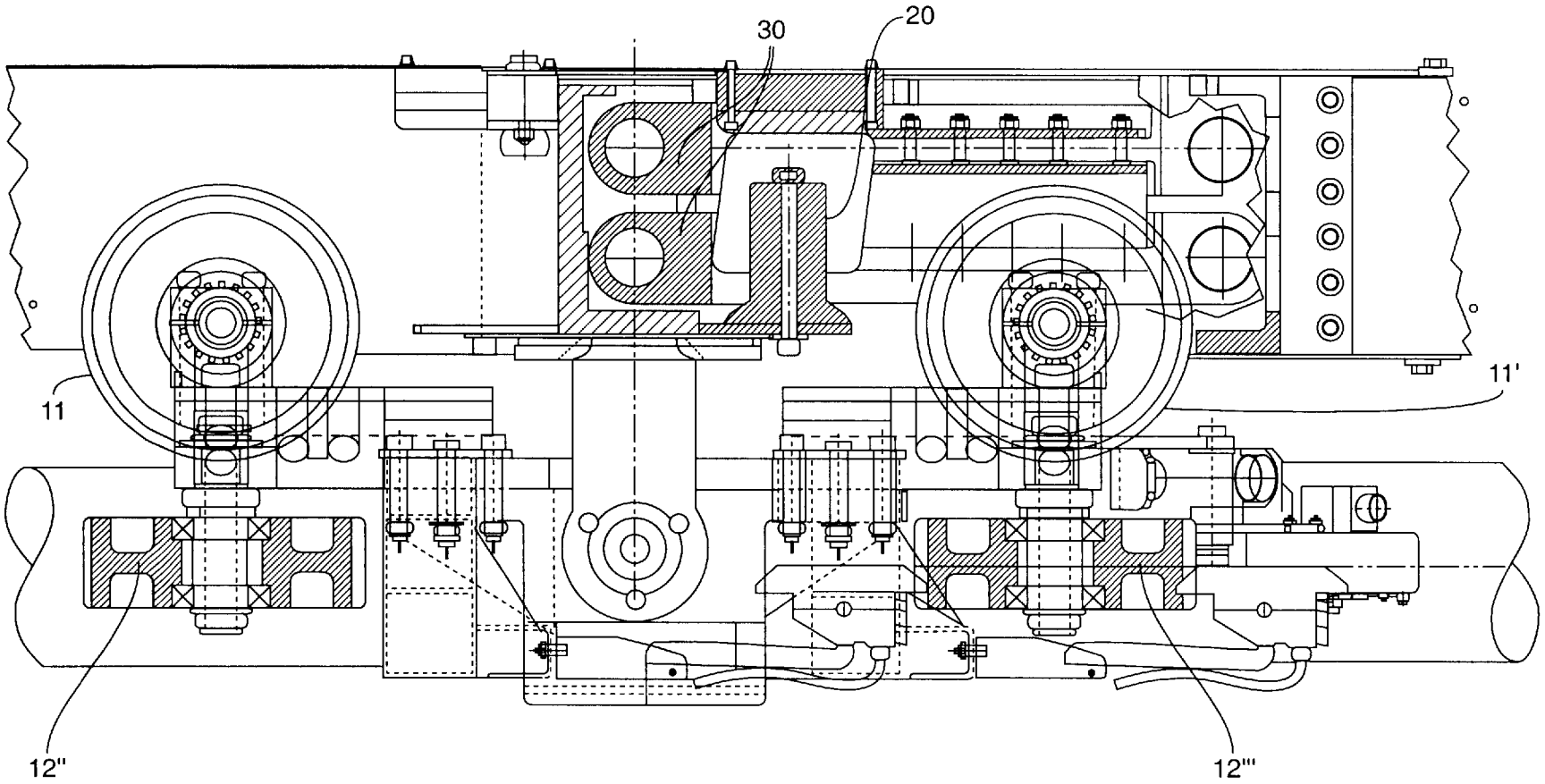
FIG. 4 is a cut away side view of a front end of the vehicle shown in FIG. 1.

A vehicle of the present invention is preferably mounted for acceleration along a trackway, such as the conventional, single support or load rail 8 as shown in FIGS. 1–3. Load rail 8 can be any suitable, conventional rail. We prefer a rail having a substantially circular cross-section as is typically used in modern roller coasters. Support rail 8 is supported conventionally above a surface, typically concrete, to which the rail 8 is mounted, using conventional rail support brackets 16. In the preferred embodiment, two driving surfaces 9, 9' are provided along each side of the support rail 8 to form a roadway. Support rail 8 is preferably positioned so that its longitudinal central axis is located in or near the plane of driving surfaces 9, 9' as shown in FIG. 1. In addition, in the preferred embodiment, where vehicle 1 is provided with an electrical propulsion system, one or more electrical conductors can be provided along load rail 8. In the preferred embodiment, shown in FIG. 2, a conventional electric bus bar 3, 3', is mounted along each side of the load rail 8. However, a single bus bar mounted along one side of the load rail, or any other conventional conductor mounted at any position where it can be accessed by a vehicle in motion along the roadway, will also work. The trackway may be conventionally laid out with a loading station at one end and an unloading station at an opposite end, or in an endless loop with one or more loading and unloading stations positioned alongside the loop for loading and unloading passengers.

Less preferably, the trackway may be constructed in any conventional manner designed to keep a vehicle on the roadway during operation. For example, a conventional roadway formed from substantially smooth asphalt or concrete path like a roadway can be provided with guide rails, ridges, or similar barriers extending upwards from the roadway (for coacting with the inside surface of the vehicle wheels), or alongside the roadway (for coacting with the outside surface of the vehicle wheels or vehicle body) for preventing the wheels of the vehicle from moving laterally off the roadway. See, e.g., U.S. Pat. No. 5,595,121, which is incorporated herein by reference, for other possible configurations.

The Vehicle

As shown in FIGS. 1–3, vehicle 1 includes a front end 5, a rear end 6, and a chassis 15 to which is attached a vehicle body 13, including a passenger compartment having one or more passenger seats 14, 14', 14", 14"'. Passenger seats 14, 14', 14", 14"' are preferably provided with conventional passenger restraints. Passenger restraints which automatically lower or lock to secure each rider in the seat at the beginning of the ride, and raise or unlock as the vehicle comes to a stop at the end of the ride to permit unloading of passengers are preferred. However, manually engageable and disengageable passenger restraints, such as seat belts, may also be used. While passenger restraints are not required for generating a wheelie, they are preferred for obvious safety reasons.

As shown in FIGS. 1–3, chassis 15 preferably includes, near each end 5, 6 of vehicle 1, a wheel assembly for moving the vehicle 1 on the load rail 8. The front wheel assembly 17 and the rear wheel assembly typically include a pair of load wheels 11, 11' for running along the top surface of the load rail 8, transmitting a substantial portion of the load of the vehicle and passengers to the load rail 8. More preferably, the weight of the rear end 6 of the vehicle is carried by drive wheels 7, 7', eliminating the need for load wheels 11, 11' in the rear wheel assembly.

Each wheel assembly also most preferably includes four guide wheels 12, 12', 12", 12"', mounted so that two guide wheels 12, 12' are located along a first side of the load rail 8 and two guide wheels 12", 12"' are located along an opposite, second side of load rail 8. The purpose of the guide wheels 12, 12', 12", 12"' are to guide the vehicle 1 along the load rail 8, and to prevent the load wheels from slipping laterally off the load rail 8. While less preferable, it would be possible to reduce or increase the number of load wheels or the number of guide wheels to achieve a similar result.

Chassis 15 also preferably includes a pair of drive wheels 7, 7' at or near the rear end 6 of the vehicle for propelling the vehicle 1 along the driving surface 9, 9'. Drive wheels 7, 7' are preferably mounted to an axle extending across the rear portion of the chassis 15 from right to left, with drive wheel 7 mounted to the right end of the drive axle, and drive wheel 7' mounted to the left end of the drive axle. Drive wheels 7, 7' are driven by motor 2, which is most preferably an electric motor. Alternatively, motor 2 could be any conventional propulsion means, such as an impulse, gasoline or diesel motors. Less preferably, drive wheels 7, 7' could each be mounted to a separate axle, as shown in FIG. 3, and vehicle 1 could be propelled by a plurality of motors.

Drive wheels 7, 7' are preferred because they simulate the appearance and action of the rear end of a dragster. While less preferable, it would be possible to eliminate the drive wheels altogether and adopt another conventional drive system such as, for example, that disclosed in U.S. Pat. No. 5,595,121, or to use a more conventional vehicle like an automobile with four wheels operated on a trackway with guide rails, ridges or other barriers to prevent the wheels from leaving the trackway.

In the preferred embodiment, two or more conventional bus bar shoes 10, 10' can be mounted to the chassis in a position to place them in contact with bus bars 3, 3' when the vehicle 1 is positioned for movement along the load rail 8. To transfer electricity from the bus bars 3, 3' of the preferred embodiment,. Bus bar shoes 10, 10' are connected conventionally to transfer electricity to motors 2, 2'.

To achieve a natural wheelie motion at a low acceleration, the weight distribution of the vehicle is an important consideration. Weight must be allocated so that a reasonably small acceleration will allow the front end 5 of vehicle 1 to easily and naturally pivot upward, most preferably about an axis 18 (shown in FIGS. 2–3) passing through the drive wheel axles. To help achieve a proper distribution of mass which will enable an easy generation of a wheelie during relatively low acceleration, the vehicle components are preferably arranged so that, when average passenger loading is taken into consideration, the vehicle is balanced about the axis 18 passing through the drive axle. To adjust for the differences between the average passenger loading and the actual passenger loading, the present invention contains a means for balancing or levelling the vehicle about the longitudinal axis 18 passing through the center of the drive axle.

The levelling process is most preferably carried out using at least one air spring 20, shown in FIG. 2, located near the front end 5 of vehicle 1, most preferably over the front wheel assembly 17, for adjusting the position of the chassis 15 relative to the front wheel assembly 17. Air springs preferred for use in this invention are those typically used on semi-tractor trailers, such as, for example, Firestone Part No. 1T12E-3. While one airspring is preferred, it would also be possible to use two or more airsprings for achieving the same result. Likewise, devices other than airsprings, such as mechanical torsion springs, although not preferred can be used to adjust the front end of the vehicle and should, accordingly, be considered as within the scope of the present invention.

Figure 6:
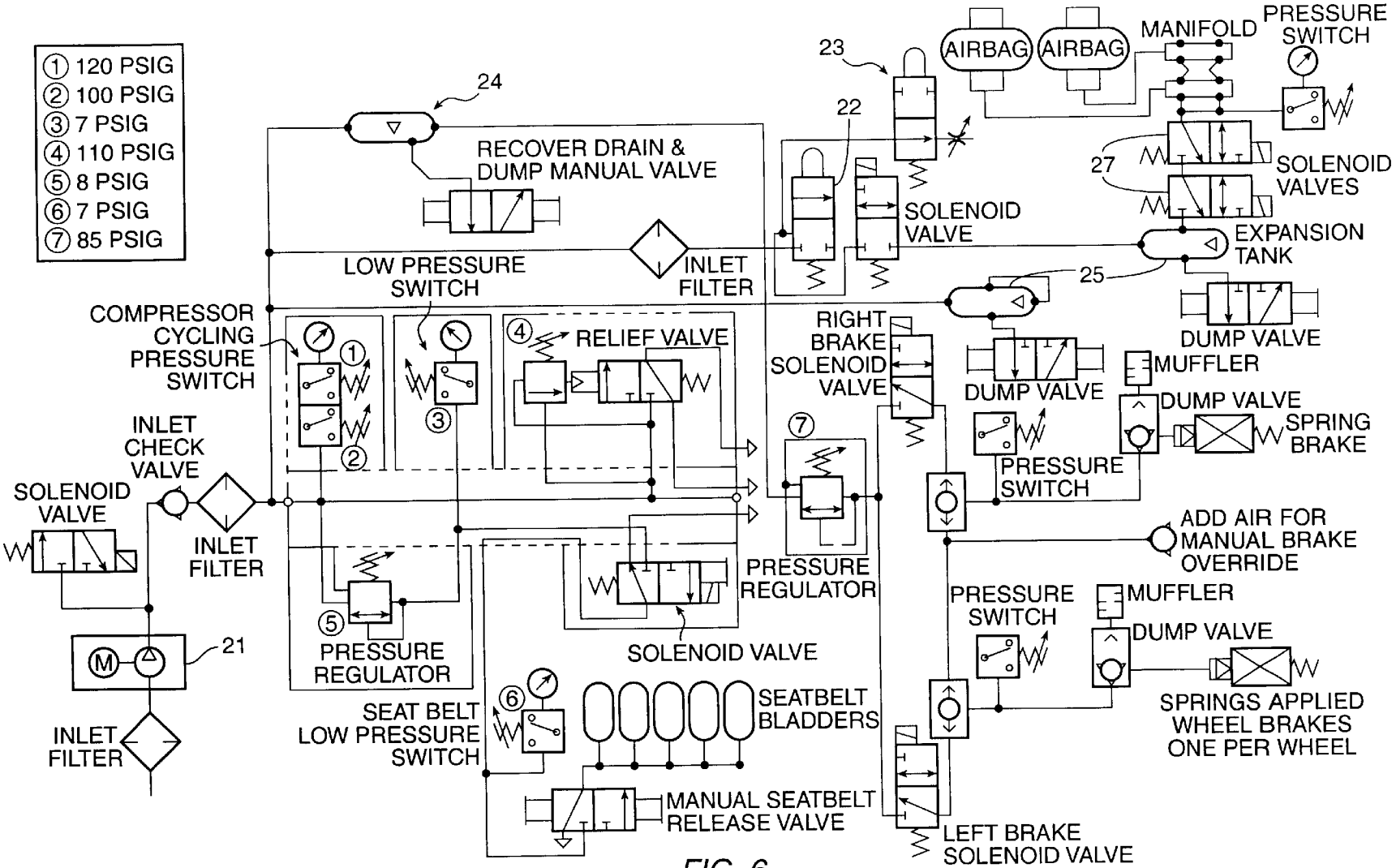
FIG. 6 is a schematic of a pneumatic system for leveling a vehicle of the present invention; and, FIG. 7 is a side view of a vehicle of the present invention illustrating the wheelie motion.

As shown in FIGS. 2 and 6, air spring 20 is charged using compressed air to level the chassis. Preferably, air is supplied by the compressor 21 at about 120 pounds per square inch ("psi") to air receivers 25 for storing compressed air for use during leveling in addition to air supplied directly by the compressor 21. Receivers 25 supply high volumes of air to reduce the leveling sequence time. During the leveling process, air is passed from compressor 21 and air receivers 25 to air spring 20. Initially, a lower limit valve 22 (a mechanical limit valve) can be actuated allowing air to pass into spring 20. As the air pressure in each air spring 20, 20' is increased, the front end 5 of vehicle 1 raises. When vehicle 1 reaches a predetermined level, an upper limit valve 23 (also a mechanical limit valve) can be activated. This valve 23 stops the flow of air. If the level of the front end 5 is initially too high (i.e. passenger loading is too light), the upper limit valve 23 should exhaust enough air to lower vehicle 1 to its proper height. The trip point position of upper and lower limit valves 23, 22 (respectively) can be subsequently adjusted to provide the sufficient leveling pressures to air spring 20 such that the chassis raises just off its jounce bumpers when properly leveled. Jounce and rebound bumpers provide stops for limiting the wheelie motion generated after balancing vehicle 1 when vehicle 1 is subjected to acceleration and cushion ends of travel stops.

Upper and lower limit valves 23, 22 (respectively) are preferably connected to a first solenoid valve 26, which will only allow limit valves 22, 23 to function during the leveling process, and will turn them off so that they cannot function during the ride. Deactivating valves 22,23 will prevent further adjustment as the vehicle begins moving down the track and generates a wheelie. Once the ride is completed, the passengers have been unloaded, and new passengers have been loaded, solenoid valve 26 receives an electrical signal, reactivating the lower and upper limit valves 22,23 to again initiate the leveling process.

Preferably, an expansion tank 25' is connected to the two air springs 20 in the preferred embodiment. The purpose of expansion tank 25' is to increase the effective volumetric air capacity of air spring 20. By increasing the effective air volume, the force generated by air spring 20 remains more constant during the wheelie. If expansion tank 25' was not used, the wheelie motion would be less natural under some loading conditions.

While air spring 20 is most preferred, other conventional means for raising and lowering the front end 5 of the vehicle chassis to compensate for actual passenger loading which differs from average passenger loading can also be used.

Figure 5:
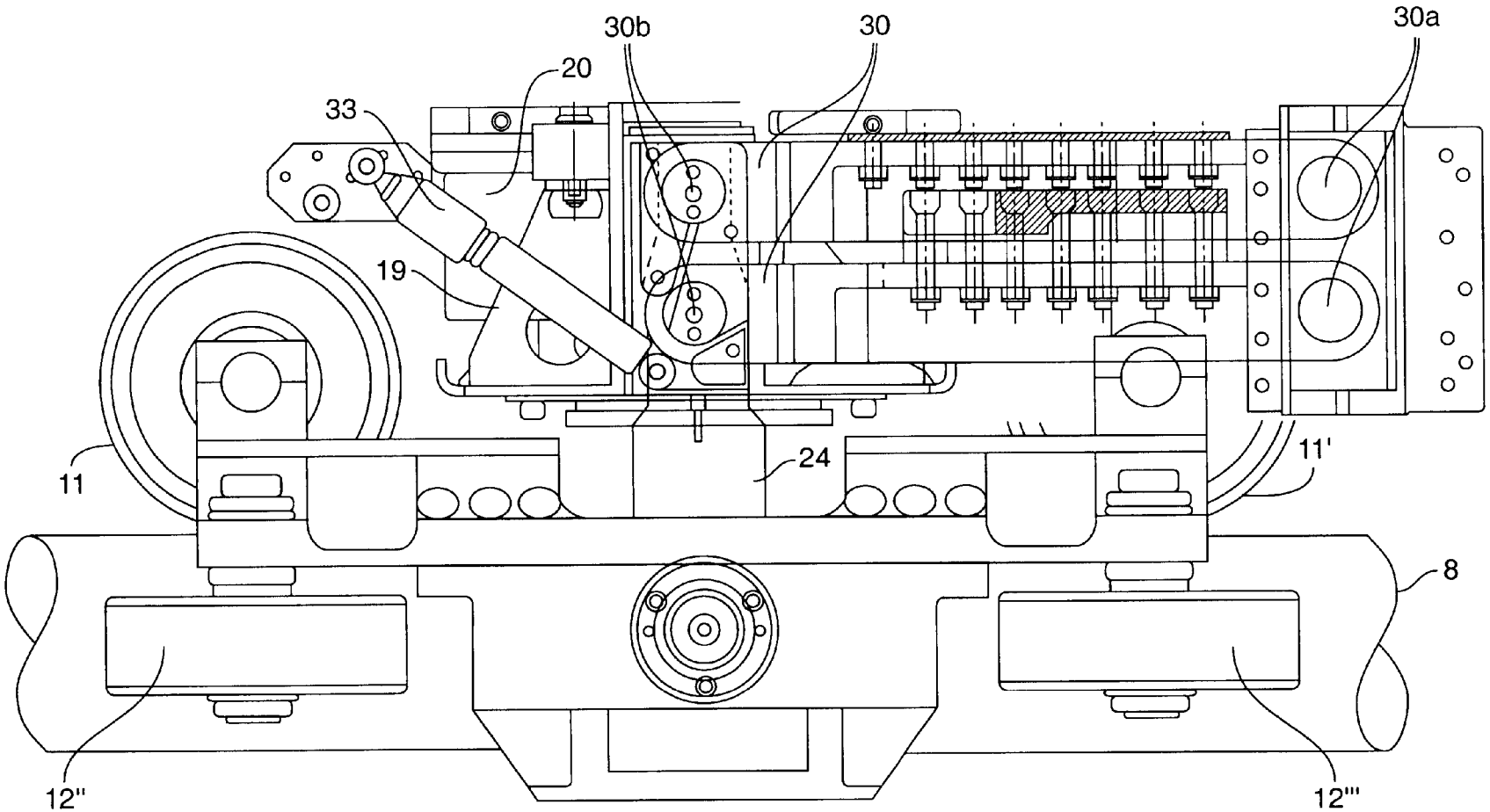
FIG. 5 is a different cut away side view of a front end of the vehicle shown in FIG. 1.

As shown in FIGS. 2 and 5, one or more shock absorbers or dampers 33 can be installed in series with the air spring 20. Shock absorber 33 dampens the wheelie motion making vehicle 1 raise and lower smoothly. Shock 33 can be tuned to finely adjust the feel of the wheelie motion. This "tuning" can be accomplished through initial shock design, or by using a conventional, externally adjustable shock to adjust the damping rates relative to the jounce and rebound bumpers.

Figure 7:
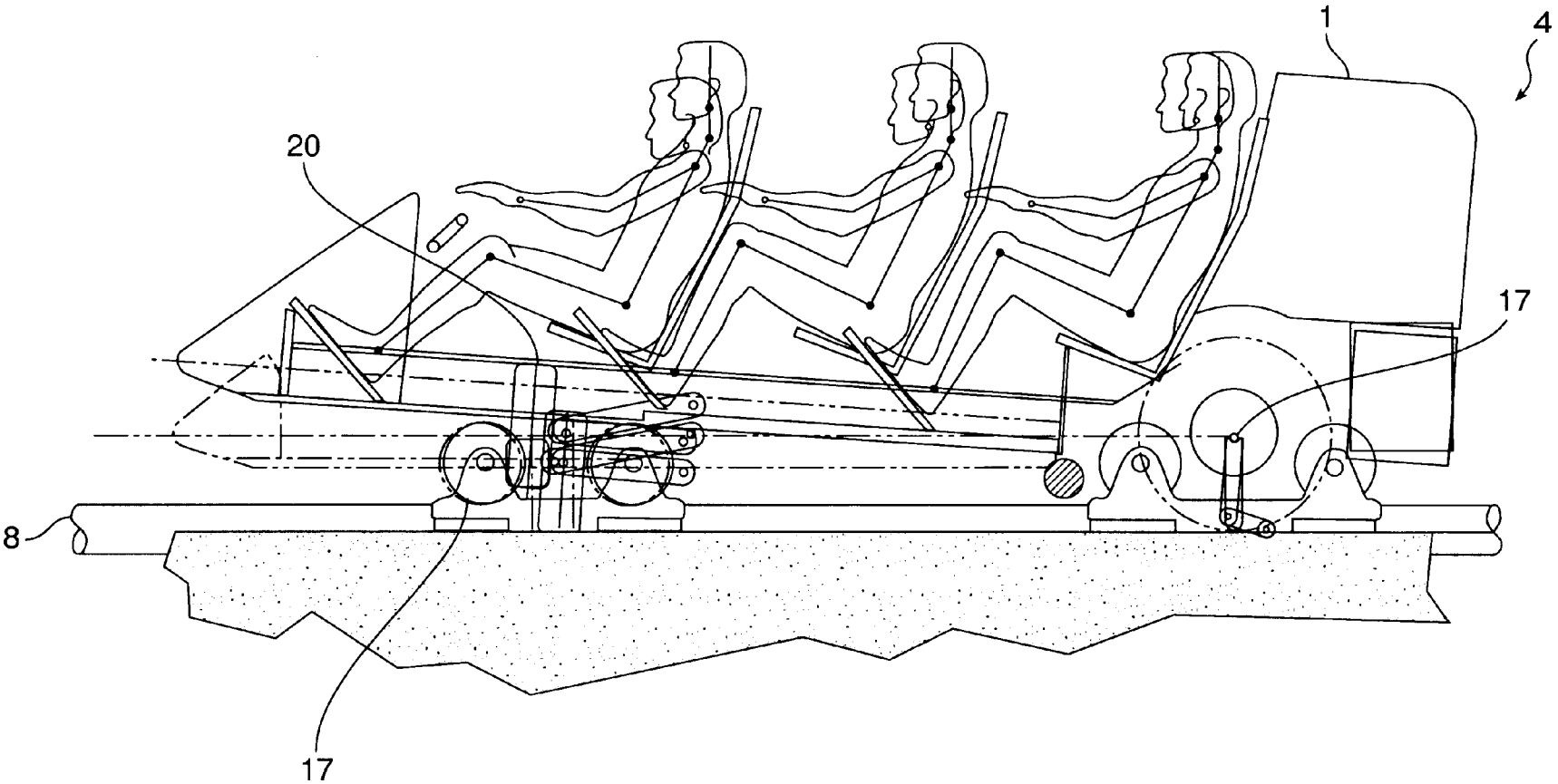

As shown in FIGS. 2–5, two control arms 30, 30' are preferably provided for control of the wheelie. Control arms 30, 30' can be pivotally mounted at one end (30*a*) to the chassis 15 at the front end 5 of vehicle 1, and at the other end (30*b*) to the front wheel assembly 17. More preferably, the front end of chassis 15 is formed by a spring perch 19 and yoke 24, as shown in FIG. 3, and end 30*a* is pivotally mounted to chassis 15, while end 30(*b*) is mounted to spring perch 19. The control arms 30, 30' control the upward movement of the front end of vehicle 1, while the front wheel assembly 17 remains in engagement with rail 8. The amount of vertical travel is limited by the length of control arms 30, 30' and can be further limited in the preferred embodiment by the position of the jounce and rebound bumpers. This control arm configuration is particularly preferred for functional and safety reasons, since the front end of passenger compartment 13 of vehicle 1 moves upward during the wheelie, but the relatively heavy front wheel assembly 17 remains on track 8, as shown in FIG. 7. Since front wheel assembly 17 does not move upward during the wheelie motion, its weight is not included in the levelling/weight balancing which is required to place the vehicle in condition to perform a wheelie at low acceleration rates.

Spring perch 19 and yoke 24, shown in FIG. 3, are preferred because they provide additional degrees of freedom in the vertical and horizontal axes. If vehicle 1 travels on a vertically or horizontally curved track 8, these additional degrees of freedom enable vehicle 1 to negotiate compound curves in the vertical and horizontal axes. While preferred, spring perch 19 and yoke 24 not necessary to produce a natural wheelie motion upon acceleration, and are not needed if vehicle 1 moves along a straight track.

The present invention does not require computer control or sensing for normal operation of the air spring balancing mechanism. However, in the preferred embodiment electrical signals will typically be needed to activate the means for balancing the chassis (i.e., the airsprings and associated solenoids, limit valves, compressor and air receivers) during the leveling sequence, to run and stop the vehicle, for discharge/unloading and/or preparing the vehicle for loading. Such electrical signals can, of course, be generated by any conventional means such as, for example, conventional ride control switches controlled manually by a ride operator, a central ride controller for automatically transmitting the correct signal to the appropriate component on the vehicle, or by a vehicle controller in electrical communication with the solenoids. Where a vehicle controller is used, communication may be established using any conventional transmitter/receiver capable of communicating with the ride controller for controlling the movement of multiple vehicles on a single track. See, e.g., U.S. Pat. No. 5,595,121 for examples of how this can be accomplished. In the preferred embodiment, once the means for balancing the chassis has been activated by an electrical signal, it operates to automatically balance the front end of the vehicle to a position between the limit valves and then shut off (before the vehicle begins to move down the track). A ride computer will then preferably control the speed of the vehicle on the track, braking, and the spacing between multiple ride vehicles where more than one vehicle is mounted for movement along the track.

Operation of the Ride

Vehicle 1 of the preferred embodiment is positioned at a loading platform so that the load wheel assembly 17 engages rail 8 and drive wheel 7 rests atop driving surface 9 and drive wheel 7' rests atop driving surface 9'. Passengers are seated in one or more of seats 14, 14', 14", 14"', and a restraining system is most preferably engaged to secure each passenger to his or her seat. Once the passengers are all seated and secured, the front of the vehicle is balanced to compensate for the differences, if any, between the actual passenger loading and the average passenger loading used initially to balance the vehicle about the longitudinal axis 18 passing through the drive axle. To start this process, an electrical signal is generated either manually (e.g., by an operator throwing a switch), or automatically (e.g., by a controller), to open the solenoid valve 26. The position of the vehicle chassis relative to the front wheel assembly actuates the limit valves. Therefore, actual passenger loading is compensated for by precharging the air spring by allowing air to pass into the air spring (and expansion tank if present) from an air receiver and/or a compressor. As the air spring's pressure is increased, the front of the vehicle raises until it reaches an upper limit determined by the upper limit valve (a mechanical limit valve), at which point the air flow is stopped by the upper limit valve. The upper and lower limit valves can be adjusted so that the chassis raises just off the jounce bumpers.

Once the vehicle has been levelled, the first solenoid shuts off the upper and lower limit valves to prevent their operation during the ride. A signal is sent to activate motor 2 which rotates drive wheels 7. 7', moving vehicle 1 away from the loading platform along rail 8. As shown in FIG. 7, when a predetermined acceleration is reached, front end 5 automatically rotates upwardly about axis 18 to pop a "wheelie" as the vehicle continues moving down the track 8. For example, an acceleration rate of 0.5 g, which is much lower than the several g's of acceleration required for normal drag race cars, should easily cause vehicle 1 to wheelie. The upward movement of front end 5 of the preferred embodiment is dampened by shock absorber 33 to create a very smooth and natural feeling motion, and is limited by jounce and rebound bumpers, although the length of the control arms will also limit and control the upward movement of front end 5. The vehicle 1 continues along the track, accelerating to pop a wheelie, and decelerating to allow the front end to drop down, until the end of the ride is reached. At the end of the ride, the vehicle comes to a stop, the passenger restraint system is released/deactivated, and the passengers step out of the vehicle.

Of course, it would be possible to provide an acceleration control inside vehicle 1 to allow one or more passengers to manually accelerate the vehicle to a predetermined value sufficient to cause a wheelie when desired. Alternatively, where an on-board controller is provided, the controller can be programmed to produce sudden and unexpected accelerations (and their accompanying wheelies) to increase thrill. Furthermore, it would be possible to lay out multiple parallel trackways to allow passengers to "race" their vehicle along their trackway against passengers on other trackways, as is done in a real drag race.

The present invention has been described in terms of the preferred embodiment. One skilled in the art will recognize that it would be possible to modify the arrangement of the components in a variety of ways. One skilled in that art will also recognize that equivalent elements could be used to achieve the same results of the present invention.

What is claimed is:

1. An amusement ride which simulates a wheelie experienced by a rapidly accelerating dragster car, the ride comprising:

a trackway including a guide rail;

a vehicle for traveling on said trackway, said vehicle including a chassis having a front end and a rear end;

a passenger compartment mounted on said chassis for seating at least one passenger;

a guide rail engagement means mounted to said chassis for engaging said guide rail;

a first drive wheel mounted for rotation at a right rear end of chassis, and a second drive wheel mounted for rotation at a left rear end of said chassis, said drive wheels for propelling said vehicle along said trackway;

a motor means mounted to said chassis for rotating said drive wheels about an axis; and, an automatic levelling mechanism mounted between said guide rail engagement means and said chassis for adjusting the position of the front end of the chassis to balance the chassis about said axis for specific passenger loading conditions, whereby forward acceleration in excess of a predetermined minimum will cause the front end of the chassis to automatically move upward in a wheelie while the first drive wheel and the second drive wheel remain on said trackway.

2. The ride of claim 1 wherein said guide rail engagement means comprises a first wheel assembly mounted at said front end of said chassis and a second wheel assembly mounted at a rear end of said chassis, each said wheel assembly including at least one load bearing wheel for riding on a top surface of said rail, and at least one guide wheel mounted on each side of said load bearing wheel for preventing said load bearing wheel from slipping off said rail.

3. The ride of claim 2 wherein each said wheel assembly includes two load bearing wheels and four guide wheels.

4. The ride of claim 1 additionally comprising a means for limiting the upward movement of the front end of the chassis as the vehicle accelerates beyond a predetermined level in a forward direction.

5. The ride of claim 1 wherein said motor means is at least one electric motor.

6. The ride of claim 5 wherein said trackway includes an electric conductor for supplying electricity for operating said motor, and wherein said vehicle includes a pickup means for conducting electricity from said conductor to said motor.

7. The ride of claim 6 wherein said electric conductor is a bus bar and said pickup means is a bus bar shoe mounted beneath said chassis to engage said bus bar as said vehicle is propelled along said rail.

8. The ride of claim 1 wherein said automatic levelling mechanism includes an air spring in communication with an air supply means.

9. The ride of claim 8 wherein said air supply means comprises an air receiving tank filled by an air compressor.

10. The ride of claim 8 wherein said air spring includes an expansion tank.

11. The ride of claim 8 additionally including a solenoid valve for opening communication between said air supply means and said air spring, and upper and lower limit valves for controlling the air flowing into and out of the air spring depending upon a position of the front end of the chassis relative to the guide rail engagement means.

12. The ride of claim 11 additionally comprising a jounce bumper for damping downward motion of said front end of said chassis and a rebound bumper for damping upward motion of said front end of said chassis.

13. The ride of claim 12 wherein said lower limit valve and said upper limit valve are adjustable to balance the chassis in a static position whereby the chassis is located just above the jounce bumper.

14. The ride of claim 13 including a dampening means for dampening the upward movement of the front end of the chassis during acceleration.

15. The ride of claim 1 additionally comprising an solenoid valve for switching the automatic levelling mechanism off and on.

16. The ride of claim 4 wherein said means for limiting the upward movement of the front end of the chassis includes a control arm pivotally mounted at a first end to said chassis and pivotally mounted at a second end to said front wheel assembly.

17. An amusement ride vehicle for riding along a trackway, said vehicle having a front end and a rear end, said vehicle comprising:

a chassis having a front end and a plurality of wheels mounted for moving the chassis along the trackway;

a passenger compartment mounted on said chassis for seating at least one passenger;

a means for accelerating the vehicle in a forward direction along said trackway; and, a means for automatically balancing the chassis about a predetermined center of gravity, after passengers have been seated in said passenger compartment, whereby forward acceleration in excess of a predetermined minimum will cause the front end of the chassis to automatically move vertically upward in a wheelie while the wheels remain on the trackway.

18. The vehicle of claim 17 additionally comprising a guidance means attached to the chassis and engaging the trackway for guiding the vehicle along the trackway.

19. The vehicle of claim 17 wherein said predetermined minimum is at least about 0.5 Gs.

20. The vehicle of claim 17 additionally including a means for limiting the upward movement of said front end of said chassis when said vehicle accelerates above said predetermined minimum.

21. A method for generating a wheelie in an amusement ride vehicle mounted for movement along a trackway, the vehicle having a front end, a rear end, a chassis having a front end and a rear end, front wheels for supporting the front end of the vehicle on the trackway, rear wheels for supporting the rear end of the vehicle on the trackway, a passenger compartment mounted on the chassis for seating at least one passenger; a means for accelerating the vehicle in a forward direction along the trackway, a levelling means for automatically levelling the vehicle about a predetermined center of gravity, and a connector means joining the front wheels to the front end of the chassis for permitting the front end of the chassis to move upward in a wheelie motion when the vehicle accelerates beyond a predetermined minimum value, the method comprising the steps of:

loading at least one passenger into said vehicle;

activating the levelling means, which automatically adjusts a position of the front end of the chassis relative to said front wheels to compensate for passenger loading;

accelerating the vehicle beyond the predetermined minimum value in a forward direction along the trackway to generate a wheelie while the front wheels remain in contact with the trackway.

22. The method of claim 20 wherein the predetermined minimum value to which the vehicle must be accelerated to achieve a wheelie is at least about 0.5 Gs.

* * * * *